US005110421A

United States Patent [19]

Gabrielson

[11] Patent Number: 5,110,421

[45] Date of Patent: May 5, 1992

[54] METHOD FOR SELECTIVELY COATING SURFACES OF COMPONENTS

[75] Inventor: Alan L. Gabrielson, Bristol, Conn.

[73] Assignee: The Torrington Company, Torrington, Conn.

[21] Appl. No.: 705,590

[22] Filed: May 24, 1991

[51] Int. Cl.[5] ..... C25D 5/02

[52] U.S. Cl. ..... 205/131; 205/221

[58] Field of Search ..... 204/15

[56] References Cited

U.S. PATENT DOCUMENTS 4,886,585 12/1989 Martinou ..... 204/23

*Primary Examiner*—T. M. Tufariello

*Attorney, Agent, or Firm*—Michael H. Minns

[57] ABSTRACT

A process for selectively plating separate surfaces of a component. The process includes electroplating a first material onto a first surface, applying a masking agent to the component, tumbling a plurality of components to remove the masking agent from a second surface, electroplating a second material onto the second surface, the masking agent preventing electroplating on the first surface, and then removing the masking agent from the first surface.

5 Claims, No Drawings

METHOD FOR SELECTIVELY COATING SURFACES OF COMPONENTS

BACKGROUND OF THE INVENTION

This invention relates generally to a method for electroplating components and more particularly to a method for selectively electroplating one surface with a first material and electroplating a second surface with a second material The unprotected steel components typically used for bearing parts are adversely affected by many hostile application environments. A wide variety of protective coatings are used to minimize part deterioration caused by corrosion, wear, etc. However, there are instances where a single coating may not be sufficient or cost effective in eliminating the problem Chromium is widely used to prevent corrosion, reduce wear, and lower friction. Chromium is relatively costly and in certain applications will generate a strong galvanic cell with adjoining materials. This is particularly true in airframes where chromium coated bearings installed in aluminum housings are unacceptable. However, the previously noted properties of chromium are very desirable for internal bearing surfaces Applying chromium to the internal surfaces of a bearing and an acceptable coating, such as cadmium, to the external surfaces has proven very difficult and costly. Extensive manual masking is needed to protect the first coating deposited while the second coating is being applied.

The foregoing illustrates limitations known to exist in present methods for selectively coating components. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a process for selectively plating separate surfaces of a component, the process includes electroplating a first material onto a first surface, applying a masking means to the component, tumbling a plurality of components to remove the masking means from a second surface, electroplating a second material onto the second surface, and then removing the masking means from the first surface. The masking means prevents the second material from electroplating on the first surface.

The foregoing and other aspects will become apparent from the following detailed description of the invention.

DETAILED DESCRIPTION

The preferred embodiment of this method is suitable for electroplating of a first corrosion resistant bearing material, such as chromium, on the bearing raceway surface of an outer race and then electroplating a second corrosion resistant material, such as cadmium, on the remaining surfaces of the bearing outer race without affecting the first material. However, this method is applicable to the selective coating of other components besides bearing races.

By proper design of plating racks and anode placement in the plating tank, selected part surfaces can be chromium plated without masking the remaining surfaces. The application of chromium is the first step in this process.

The preferred chromium plating is a hard chromium, also known as thin dense chromium, rather than a bright decorative chromium. Typically, the thin dense chromium has a thickness of 50 to 80 millionths of an inch and has a hard, crack free surface.

The bearing components are then cleaned using a neutral solvent degreaser. The cleaning solution must be compatible with chromium to prevent any degradation or damage of the chromium plating. The cleaning assures that the masking agent will stick to all surfaces.

The bearing races are then batch dipped in an appropriate masking agent or stop off lacquer such as Microstop lacquer (Microstop is a trade name of the Tobler Division of the Pyramid Plastics company). The parts are air dried. Next, the lacquered parts are tumbled in a rubber barrel in a solution of water and detergent. The mechanical action of the parts rubbing against each other removes the lacquer from only the external surfaces of the outer race. Because the races are the same size and shape, the tumbling races cannot abrade the inner surfaces (which are plated with chromium). A rubber lined barrel is used to minimize any effect of the barrel on the parts. It is important that all the parts in the barrel be of like size and shape. After tumbling, the masking agent remains only on the internal chromium plated surface.

After the masking agent is removed from the external surfaces of the bearing outer race, the races are barrel plated with cadmium. Because the masking agent has not been removed from the bearing raceway, the cadmium will not plate onto the raceway.

The final step of this process is barrel tumbling the bearing races in a lacquer solvent. The solvent dissolves the masking agent remaining on the raceway and cleans and degreases the surfaces of the bearing race.

Having described the invention, what is claimed is:

1. A process for selectively plating separate surfaces of a component, the process comprising the steps of:

electroplating a first material onto a first surface;

applying a masking means to the component;

tumbling a plurality of components thereby removing the masking means from a second surface and leaving the masking means on the first surface;

electroplating a second material onto the second surface, the masking means preventing electroplating on the first surface; and removing the masking means from the first surface.

2. A process according to claim 1, further comprising:

an initial step of selecting the components to be plated, the components being of similar size and shape.

3. A process according to claim 1, further comprising:

an initial step of selecting the components to be plated, the components having a shape with an internal surface, the internal surface being said first surface and the shape being selected such that the internal surface is not affected by the mechanical interactions of the components during the tumbling step thereby removing the masking means from only an external unplated surface, the external surface being said second surface.

4. A process for selectively plating separate surfaces of a bearing ring, the process comprising the steps of:

selecting the components to be plated, the components having a shape with an internal surface, the shape being selected such that the internal surface is not affected by the mechanical interactions of the components during a tumbling step;

electroplating a first material onto the internal surface;

applying a masking means to the component;

tumbling of a plurality of components thereby removing the masking means from an external surface and leaving the masking means on the internal surface;

electroplating a second material onto the external surface, the masking means preventing electroplating on the internal surface; and removing the masking means from the internal surface.

5. A process for selectively plating separate surfaces of a bearing outer race, the process comprising the steps of:

electroplating thin dense chromium onto the bearing raceway, the thin dense chromium plating being restricted at least to the bearing raceway and adjacent surfaces through the design of the plating racks and anode placement;

cleaning the bearing races using a chromium compatible solution;

applying a masking means to the bearing races;

tumbling a plurality of bearing races removing the masking means from unplated surfaces of the bearing races, the bearing races being of similar size and shape, leaving the masking means on an internal surface;

electroplating cadmium onto said unplated surfaces, the masking means preventing cadmium from electroplating on the chromium plated surfaces; and removing the remaining masking means.

* * * * *